US009290945B2

(12) United States Patent
Beerer et al.

(10) Patent No.: US 9,290,945 B2
(45) Date of Patent: Mar. 22, 2016

(54) HYBRID COMPOSITE SHINGLES

(71) Applicant: BUILDING MATERIALS INVESTMENT CORPORATION, Wilmington, DE (US)

(72) Inventors: Margie A. Beerer, Ennis, TX (US); Matti Kiik, Richardson, TX (US); Sudhir B. Railkar, Wayne, NJ (US)

(73) Assignee: BUILDING MATERIALS INVESTMENT CORPORATION, Wilmington, DE (US)

( * ) Notice: Subject to any disclaimer, the term of this patent is extended or adjusted under 35 U.S.C. 154(b) by 0 days.

(21) Appl. No.: 14/166,574

(22) Filed: Jan. 28, 2014

(65) Prior Publication Data

US 2014/0208675 A1 Jul. 31, 2014

Related U.S. Application Data

(60) Provisional application No. 61/758,137, filed on Jan. 29, 2013.

(51) Int. Cl.
*E04D 1/00* (2006.01)
*E04D 1/28* (2006.01)
(Continued)

(52) U.S. Cl.
CPC .. *E04D 1/28* (2013.01); *E04D 1/26* (2013.01); *E04D 1/12* (2013.01); *E04D 1/18* (2013.01);
(Continued)

(58) Field of Classification Search
CPC .... Y02B 80/34; E04D 1/20; E04D 2001/005; E04D 1/28; E04D 3/30; E04D 13/002; E04D 1/18; E04D 1/265; E04D 1/12
USPC ..... 52/745.06, 748.1, 745.21, 518, 557, 52/525, 526, 538, 540, 543, 556, 561, 52/506.01; 156/60, 242, 219; 428/209, 428/143, 148, 147, 144; D25/139
See application file for complete search history.

(56) References Cited

U.S. PATENT DOCUMENTS 4,717,614 A * 1/1988 Bondoc et al. ..... 428/143
5,571,596 A * 11/1996 Johnson ..... B32B 5/28 428/143

(Continued)

FOREIGN PATENT DOCUMENTS

WO 2007126997 A1 11/2007
WO 2009114570 A1 9/2009
WO 2009134907 A1 11/2009

OTHER PUBLICATIONS

StoneShield stone Coated Metal Shingles; Metal Roof and Wall Systems; Unton Corrugating Company at http://www.unioncorrugating.com/StoneShield.html (Jan. 14, 2013).

(Continued)

*Primary Examiner* — Chi Q Nguyen
(74) *Attorney, Agent, or Firm* — Baker & McKenzie LLP

(57) ABSTRACT

The present disclosure relates, in some embodiments, to systems, articles, materials, and methods for roofing a structure including, for example, hybrid shingles comprising a first material and a second material. A hybrid shingle may comprise, in some embodiments, a first layer comprising a metallic substrate or a polymeric substrate and at least partially defining a headlap region of the shingle, a buttlap region of the shingle comprising one or more tabs interspersed with inter-tab openings, an outward-facing surface of the first layer, and a substrate-facing surface of the first layer; and a second layer comprising a base and asphalt, having a smaller area than the first layer, and at least partially defining a buttlap region of the shingle, wherein the second layer is fixed to the substrate-facing surface of the first layer.

24 Claims, 2 Drawing Sheets

(51) Int. Cl.

| | |
|---|---|
| *E04D 3/30* | (2006.01) |
| *E04D 1/20* | (2006.01) |
| *E04D 1/18* | (2006.01) |
| *E04D 1/12* | (2006.01) |
| *E04D 1/26* | (2006.01) |

(52) U.S. Cl.

CPC . *E04D 1/20* (2013.01); *E04D 1/265* (2013.01); *E04D 3/30* (2013.01); *E04D 2001/005* (2013.01); *Y10T 156/10* (2015.01); *Y10T 156/1039* (2015.01); *Y10T 428/24752* (2015.01)

(56) References Cited

U.S. PATENT DOCUMENTS

| | | | | |
|---|---|---|---|---|
| 5,666,776 | A * | 9/1997 | Weaver et al. | 52/557 |
| 6,190,754 | B1 * | 2/2001 | Bondoc et al. | 428/143 |
| 6,426,309 | B1 * | 7/2002 | Miller | D06N 5/00 427/186 |
| 6,708,456 | B2 * | 3/2004 | Kiik et al. | 52/98 |
| 6,857,239 | B2 | 2/2005 | Sadosky | |
| 6,936,329 | B2 * | 8/2005 | Kiik et al. | 428/141 |
| 6,990,779 | B2 * | 1/2006 | Kiik et al. | 52/554 |
| 8,241,728 | B2 | 8/2012 | Guerra | |
| 2003/0032356 | A1 * | 2/2003 | Kiik et al. | 442/327 |
| 2003/0040241 | A1 * | 2/2003 | Kiik et al. | 442/242 |
| 2005/0252136 | A1 * | 11/2005 | Hardin | 52/518 |
| 2006/0179767 | A1 * | 8/2006 | Miller | B32B 3/08 52/555 |
| 2007/0039274 | A1 * | 2/2007 | Harrington et al. | 52/518 |
| 2010/0275527 | A1 | 11/2010 | Karol | |
| 2011/0283646 | A1 * | 11/2011 | Vermilion et al. | 52/539 |

OTHER PUBLICATIONS

Metalworks Steel Shingles Product Data; Tamko Building Products, Inc. at http://www.tamko.com/Libraries/Documents_-_Data_Sheets/TAMKO%c2%ae_MetalWorks%c2%ae_Data_Sheet.pdf (2013).

* cited by examiner

HYBRID COMPOSITE SHINGLES

CROSS-REFERENCE TO RELATED APPLICATION

This application claims priority to U.S. Provisional Patent Application No. 61/758,137 filed on Jan. 29, 2013. The contents of all of the above applications are hereby incorporated in their entirety by reference.

FIELD OF THE DISCLOSURE

The present disclosure relates, in some embodiments, to systems, articles, materials, and methods for roofing a structure including, for example, hybrid shingles comprising a first material and a second material.

BACKGROUND

Metal roofing may include metallic sheets or shingles, which may be coated with epoxy, resins, ceramics and other materials to reduce the effects of weather on the metallic roofing and reduce its heat absorbing capacity. In addition, metal roofing may be shaped, painted, and/or coated to mask its true identity and make it look more like one of the other types of roofing (e.g., wood shake, slate, shingles or clay tiles).

Asphalt shingles are one of the most commonly used roofing materials and may include a base (e.g., glass fiber mat) saturated with asphalt. The base provides structural integrity to withstand handling and servicing. Asphalt shingles are often coated with mineral granules to enhance performance and/or aesthetics. Asphalt shingles may be manufactured as strip or three tab shingles, laminated shingles, interlocking shingles, and large individual shingles in a variety of weights and colors. Asphaltic roofing may be thicker, heavier, and, under some conditions, less durable than metallic roofing. Asphaltic roofing, however, may absorb less heat and/or may be more aesthetically pleasing than a metallic roof intended to mimic an asphaltic roof.

SUMMARY

Accordingly, a need has arisen for improved hybrid shingles that have many of the advantages while mitigating perceived disadvantages of the component materials. The present disclosure relates, in some embodiments, to systems, articles, materials, and methods for roofing a structure including, for example, hybrid shingles comprising a first material (e.g., metal, TPO) and a second material (e.g., asphalt). For example, according to some embodiments, a hybrid shingle for cladding a structure comprising a roofing substrate may comprise a first layer comprising a metallic substrate or a polymeric substrate and at least partially defining a headlap region of the shingle, a buttlap region of the shingle comprising one or more tabs interspersed with inter-tab openings, an outward-facing surface of the first layer, and/or a substrate-facing surface of the first layer; and/or a second layer comprising a base (e.g., glass fiber) and asphalt, having a smaller area than the first layer, and at least partially defining a buttlap region of the shingle, wherein the second layer is fixed to the substrate-facing surface of the first layer. In some embodiments, a first layer may up to completely cover a second layer except at the inter-tab openings. A first layer may comprise a metallic substrate (e.g., steel, an alloy, copper, aluminum, and combinations thereof) and/or a polymeric substrate (e.g., comprising a thermoplastic polyolefin), according to some embodiments. An outward-facing surface of a first layer may be at least partially covered, in some embodiments, with a material selected from the group consisting of paint, acrylic, epoxy, tar, stones, nano granules, a radiant barrier, and combinations thereof. A second layer may comprise an outward-facing surface having mineral granules, in some embodiments. A first layer and/or a second layer may comprise, in some embodiments, a colored additive and/or covering. According to some embodiments, a first layer may be thinner than the second layer, lighter than the second layer, or thinner and lighter than the second layer. A hybrid shingle, in some embodiments, may be thinner than a corresponding non-hybrid shingle (e.g., an asphalt shingle), lighter than the corresponding non-hybrid shingle, or thinner and lighter than the corresponding non-hybrid shingle. A hybrid shingle may comprise a fastener region, for example, positioned between the headlap and buttlap regions of the shingle, according to some embodiments.

The present disclosure relates to hybrid roofing systems for cladding a structure comprising a substrate in some embodiments. For example, a roofing system may comprise a plurality of hybrid shingles and/or an underlayment. A roofing system may partially, substantially, or completely cover a roofing substrate with at least one metallic and/or polymeric layer.

The present disclosure relates, in some embodiments, to methods of making and using a hybrid shingle. For example, a method of making a hybrid shingle may comprise forming an upper layer including one or more tabs a upper layer comprising a metallic substrate or a polymeric substrate and at least partially defining a headlap region of the shingle, a buttlap region of the shingle comprising one or more tabs interspersed with inter-tab openings, an outward-facing surface of the upper layer, and a substrate-facing surface of the upper layer; forming a lower layer comprising a base and asphalt, having a smaller area than the first layer, and at least partially defining a buttlap region of the shingle; and/or fixing the lower layer to the substrate-facing surface of the upper layer. A method for cladding a structure comprising a roofing substrate may comprise, for example, securing (e.g., nailing, screwing, and/or adhering) a plurality of hybrid shingles to the roofing substrate.

BRIEF DESCRIPTION OF THE DRAWINGS

Some embodiments of the disclosure may be understood by referring, in part, to the present disclosure and the accompanying drawings, wherein.

DETAILED DESCRIPTION

Figure 1A:
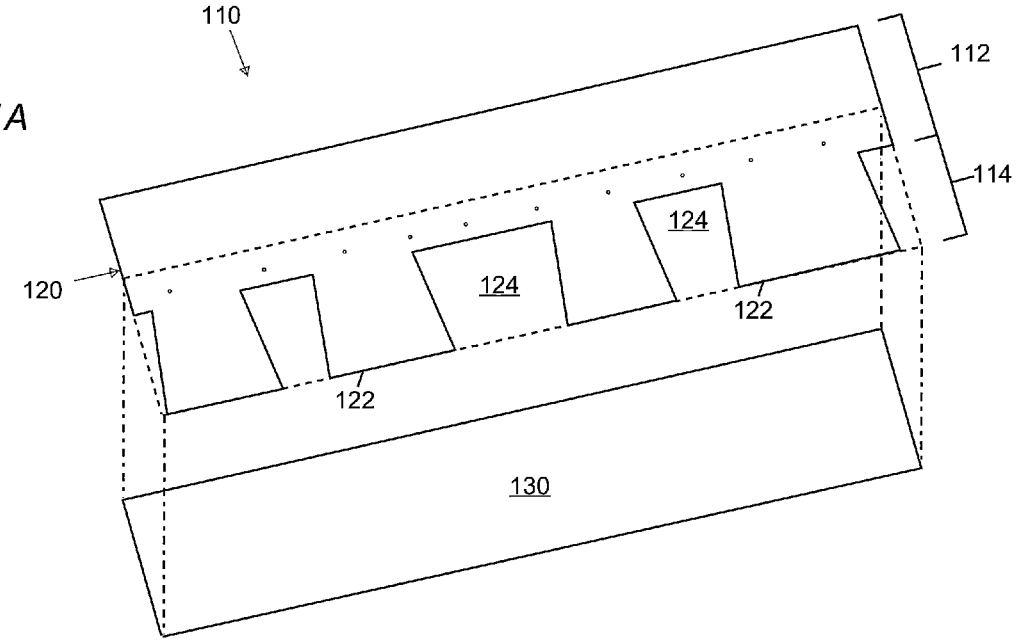
FIG. 1A is an exploded perspective view of a first layer and a second layer of a shingle according to a specific example embodiment of the disclosure.

Hybrid articles (e.g., shingles) and/or systems (e.g., roofing) may provide, according to some embodiments, one or more advantages of each of the major component materials and/or may mitigate or exclude one or more perceived disadvantages. These benefits may be provided, for example, without retooling existing machinery. In some embodiments, hybrid shingles may have the same thickness as comparable non-hybrid shingles (e.g., all metal or all asphalt shingles of equivalent exposure size) with less weight. For example, lighter shingles may facilitate transportation and/or installation. Hybrid shingles may be thinner than comparable non-hybrid shingles in some embodiments. Thinner shingles may have, according to some embodiments, one or more performance features that are at least the same as non-hybrid shingles. Reduced thickness may permit, for example, more shingles to be included in a bundle of the same size. Hybrid shingles may use and/or require less asphalt than asphalt-based shingles. In some embodiments, hybrid shingles may better resist algae, mold, and/or mildew growth. Hybrid shingles and/or roofing may function as a better sound barrier than, for example, non-hybrid shingles (e.g., an all metal roof).

Articles

The present disclosure relates, in some embodiments, to hybrid articles (e.g., shingles) comprising a first material and a second material. According to some embodiments, a hybrid shingle may comprise a first material in a first layer and a second material in a second layer. A first layer may be configured to include an upper region (e.g., a headlap region) and/or a lower region (e.g., a buttlap region). A lower region of a first layer may include one or more tabs. Tabs may be defined by inter-tab openings, in some embodiments. Inter-tab openings and/or tabs may have any desired size or shape (e.g., to suit aesthetic and/or functional goals). For example, openings and/or tabs may have a generally trapezoidal (e.g., dragon tooth) configuration A first layer may include a middle region configured to accommodate, for example, one or more fasteners to secure a shingle to another shingle and/or decking. Fasteners may be used at any desired interval (e.g., haphazard, random, regular) in some embodiments. Upper, middle, and lower regions of a first layer may be discrete and/or may partially overlap. For example, upper and lower regions may be discrete, upper and middle regions may partially overlap, and/or middle and lower regions may partially overlap. A second layer may be configured to include an upper region and/or a lower region (e.g., a buttlap region). A lower region of a second layer may be configured to be positioned beneath (e.g., closer to underlying decking) the lower region of a first layer. In some embodiments, a first layer may completely cover a second layer except at some or all inter-tab openings.

According to some embodiments, a first layer may comprise (e.g., substantially comprise) a first material. Examples of a first material include, in some embodiments, a metallic material, a polymeric material, and/or combinations thereof. A metallic material may include, for example, steel (e.g., corrugated galvanized, stainless, and others), an alloy (e.g., a zinc/aluminum alloy), copper, aluminum, and/or combinations thereof. A polymeric material may include, for example, a thermoplastic polyolefin (TPO), polyvinyl chlorine (PVC) (e.g., foamed PVC), a synthetic elastomer (e.g., ethylene propylene), ethylene propylene diene monomer (EPDM), polyvinylidene fluoride (PVDF), polypropylene (PP), polyethylene (PE), and combinations thereof. Metals and/or polymers may have one or more smooth surfaces, which may make it difficult for airborne debris, dust, and plant material to collect in some embodiments. Metals and/or polymers may not adsorb water decreasing exposure of roofing to degradation and/or microbial growth.

An upper layer (e.g., a metallic layer) may comprise a headlap region, a fastening region, and/or a tabbed region, in some embodiments. An upper layer may have any desired gauge or thickness. In some embodiments, any portion up to all of a first layer may include and/or be coated with one or more additional materials (e.g., paint, acrylic, epoxy, tar, stones, radiant barrier). For example, an outward facing surface of a first layer may be painted with one or more layers of decorative and/or protective paint.

According to some embodiments, a second layer may comprise a base (e.g., glass fiber mat) saturated with asphalt. A second layer may be coated, in some embodiments, with mineral granules and/or coated in like manner to asphalt shingles. A second layer of a shingle may be smaller in at least one dimension (e.g., area, width, height) than the first layer of the shingle, in some embodiments. Sizing the second layer smaller than the first layer may contribute to reduced weight and/or thickness. Where asphalt is used in the second layer, it may also limit the cost and/or amount of asphalt required. A second layer may be thicker than a first layer. For example, a second layer comprising asphalt may be from about 2 to about 10 times thicker than a first layer comprising metal.

In some embodiments, an upper layer (e.g., metal) and a lower layer (e.g., asphalt) may be fixed to one another by any suitable means. For example, upper and lower layers may be adhered together. Examples of adhesives for fixing upper and lower layers may include, without limitation, EPDM adhesives, modified bitumen (MOD-BIT) adhesives (e.g., MATRIX™ 102, MATRIX™103), EVERGUARD® bonding adhesives, asphalt adhesives, polymer modified asphalt adhesives, and combinations thereof.

According to some embodiments, hybrid shingles may be configured to be handled and/or installed using the same or substantially the same tools and techniques used to install non-hybrid shingles (e.g., asphalt shingles, metal shingles). Hybrid shingles may be packaged and/or shipped like or substantially like non-hybrid shingles in some embodiments. Hybrid shingles may be packaged and/or shipped in cartons, boxes, rolls, or other containers as desired. For example, hybrid shingles with a thin coating of asphalt on a metal roll may permit shipping shingle patterns on a roll. Rolled hybrid shingles, in some embodiments, may be cut to length by a roofer before installation.

A hybrid shingle may have, in some embodiments, a total thickness of about 128 mils comprising a metal layer about 18 mils and an asphalt backer about 110 mils and weigh about 1.74 pounds. Production non-hybrid shingles may have a total thickness of about 192 mils and weigh about 3.29 pounds. Thus, hybrid shingles may have about one third the thickness and half the weight of production non-hybrid shingles.

Figure 1B:
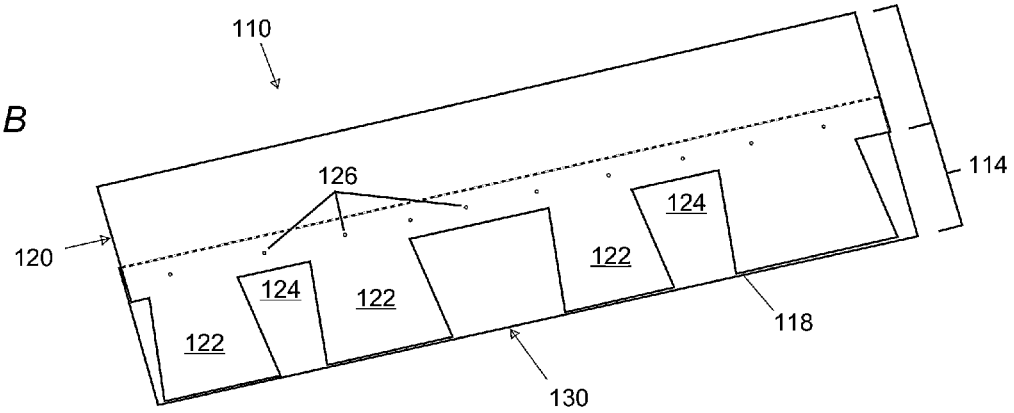
FIG. 1B is a perspective view of a first layer and a second layer of a shingle according to a specific example embodiment of the disclosure.
Figure 1C:
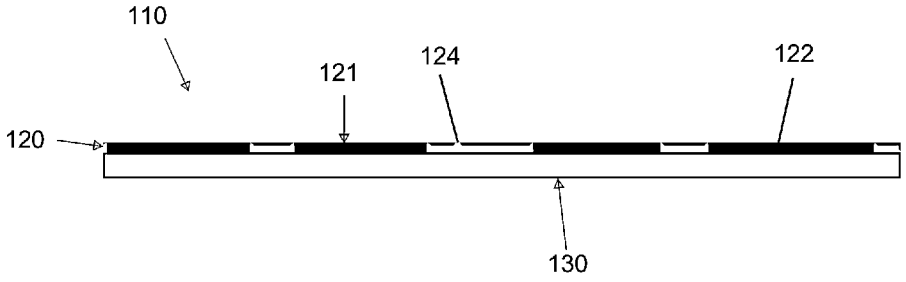
FIG. 1C is a plan view of a first layer and a second layer of a shingle according to a specific example embodiment of the disclosure.

Specific example embodiments of hybrid shingles are illustrated in FIGS. 1A-1C. FIG. 1A shows an exploded perspective view of hybrid shingle 110, which comprises upper layer 120 and lower layer 130. As shown, lower layer 130 is smaller in height than upper layer 120, and is positioned beneath a lower portion of upper layer 120.

FIG. 1B shows a perspective view of hybrid shingle 110 and FIG. 1C shows a plan view from the lower edge of shingle 110. Upper layer 120 includes an upper portion configured to be covered by the next hybrid shingle above and a lower portion including tabs 122 and interposed openings 124. Tabs 122 are illustrated here having a dragon tooth shape, but may be formed in any desired shape. In some embodiments, shingle 110 may comprise headlap 112 and buttlap 114, the latter comprising a lower region of upper layer 120 (e.g., tabs 122) and all or substantially all of lower layer 130. Upper layer 120 may also include a region for securing shingle 120 to adjacent shingle(s) and/or underlying decking including, for example, fastener holes 126. In some embodiments, hybrid shingle 110 may include asphaltic backer 130 laminated with metallic dragon tooth layer 120.

FIG. 1C is a plan view of a hybrid shingle from bottom edge 118. As shown, upper layer 120 is thinner than lower layer 130. All or a portion of outward facing surface 121 of layer 120 may be coated with paint, stones, acrylic, or other materials as desired or required. Articles may be tested to ascertain whether a finish (e.g., a decorative finish) adheres at high temperatures. For example, articles according to some embodiments of the disclosure successfully passed a 270° F. lab slump test.

Systems

The present disclosure relates to roofing systems comprising hybrid articles (e.g., shingles). A roofing system may comprise, for example, a plurality of hybrid shingles, fasteners to secure hybrid shingles to a substrate, and/or an underlayment (e.g., felt, glass fiber, gypsum, nylon, polymer membrane). A hybrid roofing system may, in some embodiments, may be configured such that 100% of a substrate (roof deck) is covered by at least one layer of metal. This may be achieved, for example, by arranging each shingle such that it overlaps at least a portion of the shingle immediately below. More specifically, at least a portion of a contiguous metal upper region of first shingle may overlap at least a portion of a contiguous metal upper region of a second shingle. In some embodiments, a contiguous metal upper region of a shingle comprises a headlap region including an upper region and a middle region and may exclude a buttlap region (e.g., lower region with tabs). Hybrid shingles and systems may be configured and arranged for use on any type of roof decking and at any pitch, slope, or angle.

Figure 2:
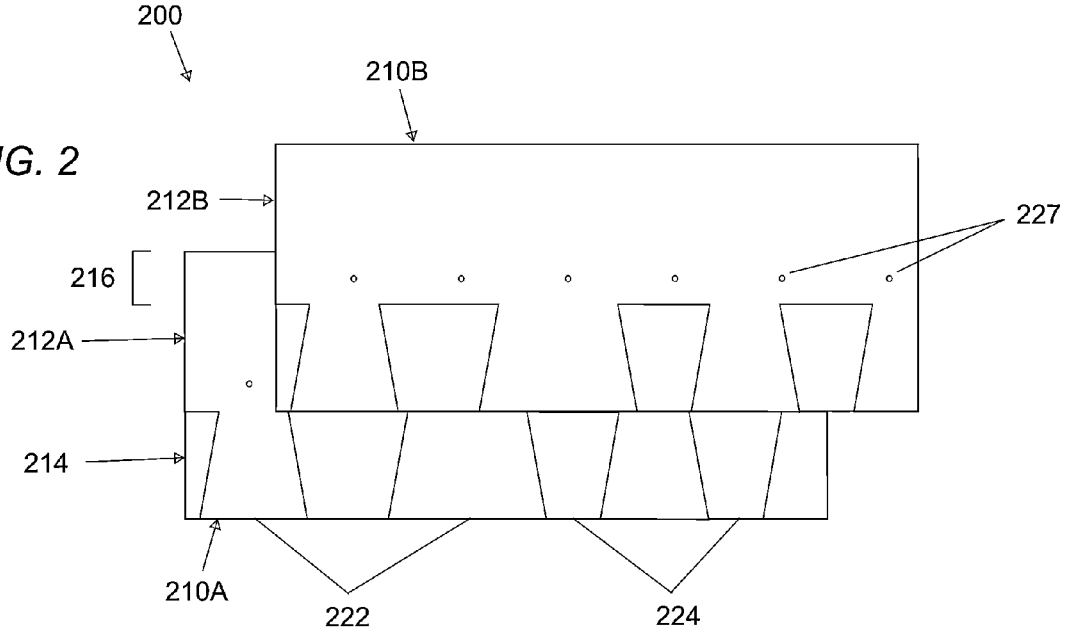
FIG. 2 illustrates a hybrid roofing system according to a specific example embodiment of the disclosure.
Figure 3:
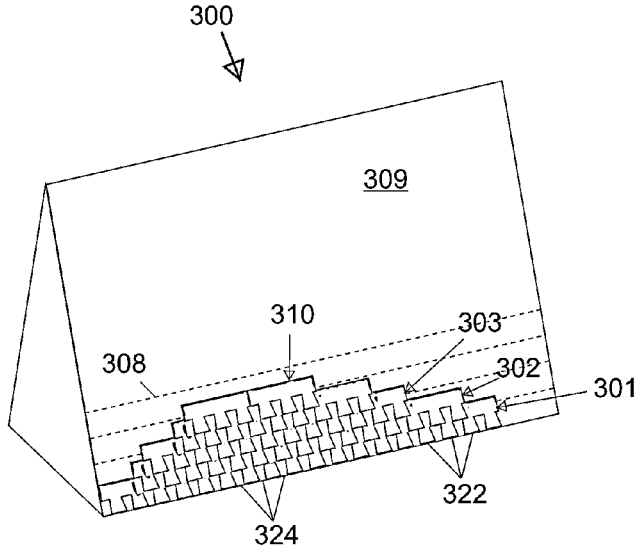
FIG. 3 illustrates a hybrid roofing system according to a specific example embodiment of the disclosure.

Specific example embodiments of hybrid roofing systems are illustrated in FIGS. 2 and 3. FIG. 2 illustrates hybrid roofing system 200 comprising hybrid shingle 210A and hybrid shingle 210B arranged such that headlap 212A and headlap 212B have overlap 216. As shown, shingle 210B may be arranged such that the lower edge of its tabs 222 are aligned with the upper edge of openings 224 of shingle 210A. Shingles 210 may be horizontally offset as shown or may be even along their edges. Shingles 210 may be secured in place with fasteners 227 (e.g., nails, screws). Shingles 210 may be offset as shown or may be even along their edges. Hybrid shingles may be arranged in succeeding rows, for example, rows 301, 302, 303 shown in FIG. 3. Shingles 310 may be positioned over strips of underlayment 308 and secured to deck 309. Roofing systems may be configured to clad roofs of significant slope as shown and/or roofs of any other grade.

Methods

In some embodiments, the present disclosure relates to methods of making and using hybrid articles (e.g., shingles). A method according to some embodiments may comprise forming an upper layer including one or more tabs, forming a lower layer, and/or joining the upper layer and the lower layer. Forming an upper layer may include, for example, cutting out a headlap/dragon teeth design from sheet metal stock (e.g., 18 mil thick). An upper layer may also be formed with one or more surface coatings in some embodiments. For example, an upper layer may be painted (e.g., spray painted) with one or more layers of paint (e.g., black or colored). An upper layer may also be formed with one or more epoxies, acrylics, and/or granules (e.g., nano granules, nano granules aluminum or metal flakes). In some embodiments, an upper layer may be formed (e.g., pressed, stamped, molded) in a desired three-dimensional shape or texture.

Forming a lower layer may comprise contacting (e.g., saturating) a base (e.g., glass fiber mat) with asphalt and (optionally) applying a coating comprising mineral granules. Upper and/or lower layer may be formed with texture and/or color additives according to some embodiments. Upper and lower layers may be joined, in some embodiments, by any suitable means. For example, upper and lower layers may be laminated and/or adhered to each other (e.g., using hot glue).

Hybrid articles (e.g., shingles) may be used, according to some embodiments, to clad a structure with a barrier that resists and/or withstands weather and the elements. A method of cladding a structure may comprise securing one or more hybrid articles to a substrate (e.g., a roofing substrate) in some embodiments. Securing a hybrid shingle may include any desired means including fasteners and/or adhesives, for example, fasteners and/or adhesives used to secure non-hybrid shingles. In some embodiments, hybrid shingles may be contacted with a substrate in a layered configuration that provides up to 100% coverage of the substrate with at least one layer of metal. Successive rows of hybrid shingles may be positioned, according to some embodiments, such that the buttlap (e.g., asphaltic backer) of each hybrid shingle in the row overlays the headlap of hybrid shingles in the preceding row. The headlap of each shingle in a row may overlap (e.g., vertically overlap) at least a portion of the headlap of one or more shingles in the immediately preceeding row, in some embodiments (e.g., as shown in FIG. 2).

As will be understood by those skilled in the art who have the benefit of the instant disclosure, other equivalent or alternative systems, articles, materials, and methods for roofing a structure including can be envisioned without departing from the description contained herein. Accordingly, the manner of carrying out the disclosure as shown and described is to be construed as illustrative only.

Persons skilled in the art having the benefit of the present disclosure may make various changes in the shape, size, number, and/or arrangement of parts without departing from the scope of the disclosure. For example, the position and number of hybrid shingles in a roofing system may be varied. In some embodiments, hybrid shingles may be interchangeable with each other and/or with non-hybrid shingles. Interchangeability may allow roof cladding to be custom adjusted (e.g., according to roof structure, exposure, aesthetics, user preference). In addition, the size of a hybrid article and/or system may be scaled up or down to suit the needs and/or desires of a user. To the extent desired and/or required, appropriate safety measures may be taken in the practice of embodiments of the disclosure. For example, if desired safety equipment may be used to protect users from potentially sharp metal edges that may be present in some embodiments. Each disclosed method and method step may be performed in association with any other disclosed method or method step and in any order according to some embodiments. Where the verb "may" appears, it is intended to convey an optional and/or permissive condition, but its use is not intended to suggest any lack of operability unless otherwise indicated. Persons skilled in the art may make various changes in methods of preparing and using a system, article, and/or material of the disclosure.

Also, where ranges have been provided, the disclosed endpoints may be treated as exact and/or approximations as desired or demanded by the particular embodiment. Where the endpoints are approximate, the degree of flexibility may vary in proportion to the order of magnitude of the range. For example, on one hand, a range endpoint of about 50 in the context of a range of about 5 to about 50 may include 50.5, but not 52.5 or 55 and, on the other hand, a range endpoint of about 50 in the context of a range of about 0.5 to about 50 may include 55, but not 60 or 75. In addition, it may be desirable, in some embodiments, to mix and match range endpoints. Also, in some embodiments, each figure disclosed (e.g., in one or more of the examples, tables, and/or drawings) may form the basis of a range (e.g., depicted value+/− about 10%, depicted value+/− about 50%, depicted value+/− about 100%) and/or a range endpoint. With respect to the former, a value of 50 depicted in an example, table, and/or drawing may form the basis of a range of, for example, about 45 to about 55, about 25 to about 100, and/or about 0 to about 100.

All or a portion of a hybrid article and/or system for cladding a structure may be configured and arranged to be disposable, serviceable, interchangeable, and/or replaceable. These equivalents and alternatives along with obvious changes and modifications are intended to be included within the scope of the present disclosure. Accordingly, the foregoing disclosure is intended to be illustrative, but not limiting, of the scope of the disclosure as illustrated by the appended claims.

The title, abstract, background, and headings are provided in compliance with regulations and/or for the convenience of the reader. They include no admissions as to the scope and content of prior art and no limitations applicable to all disclosed embodiments.

What is claimed is:

1. A hybrid shingle for cladding a structure comprising a roofing substrate, the hybrid shingle comprising:

a first layer comprising a metallic substrate or a polymeric substrate and at least partially defining a headlap region of the shingle, a buttlap region of the shingle comprising one or more tabs interspersed with inter-tab openings, an outward-facing surface of the first layer, and a substrate-facing surface of the first layer; and a second layer comprising a base and asphalt, having a smaller area than the first layer, and at least partially defining the buttlap region of the shingle, wherein the second layer is fixed to the substrate-facing surface of the first layer and the second layer is from about 2 to about 10 times thicker than the first layer.

2. A hybrid shingle according to claim 1, wherein the first layer completely covers the second layer except at the inter-tab openings.

3. A hybrid shingle according to claim 1, wherein the first layer comprises a metallic substrate.

4. A hybrid shingle according to claim 3, wherein the metallic substrate comprises a metal selected from the group consisting of steel, an alloy, copper, aluminum, and combinations thereof.

5. A hybrid shingle according to claim 3, wherein the polymer comprises a thermoplastic polyolefin.

6. A hybrid shingle according to claim 1, wherein the first layer comprises a polymeric substrate.

7. A hybrid shingle according to claim 1, wherein the outward-facing surface of the first layer is at least partially covered with a material selected from the group consisting of paint, acrylic, epoxy, tar, stones, nano granules, metal flakes, coated mica, a radiant barrier, and combinations thereof.

8. A hybrid shingle according to claim 1, wherein the base comprises glass fiber.

9. A hybrid shingle according to claim 1, wherein the second layer further comprises an outward-facing surface comprising mineral granules.

10. A hybrid shingle according to claim 1, wherein the second layer comprises a colored additive.

11. A hybrid shingle according to claim 1, wherein the first layer is thinner than the second layer, lighter than the second layer, or thinner and lighter than the second layer.

12. A hybrid shingle according to claim 11, wherein the shingle is thinner than a corresponding non-hybrid shingle, lighter than the corresponding non-hybrid shingle, or thinner and lighter than the corresponding non-hybrid shingle.

13. A hybrid shingle according to claim 12, wherein the non-hybrid shingle is an asphalt shingle.

14. A hybrid shingle according to claim 1, wherein first layer further comprises a fastener region positioned between the headlap and buttlap regions of the shingle.

15. A hybrid roofing system for cladding a structure comprising a roofing substrate, the hybrid roofing system comprising:

a plurality of hybrid shingles each hybrid shingle having a first layer and a second layer, the first layer comprising a metallic substrate or a polymeric substrate and at least partially defining a headlap region of the shingle, a buttlap region of the shingle comprising one or more tabs interspersed with inter-tab openings, an outward-facing surface of the first layer, and a substrate-facing surface of the first layer, the second layer comprising a base and asphalt, having a smaller area than the first layer, and at least partially defining the buttlap region of the shingle; and an underlayment, wherein the total thickness of the hybrid shingle is about 128 mils, wherein the thickness of the first layer is about 18 mils, wherein the second layer is fixed to the substrate-facing surface of the first layer, and wherein the second layer is from about 2 to about 10 times thicker than the first layer.

16. A hybrid roofing system according to claim 15, wherein the hybrid shingles are arranged in at least a first row and a second row at least partially overlapping the first row.

17. A hybrid roofing system according to claim 16, wherein at least a portion of the headlap of the at least one shingle in the second row overlaps at least a portion of the headlap of the at least one shingle in the first row.

18. A hybrid roofing system according to claim 17, wherein the first layer comprises a metallic substrate.

19. A hybrid roofing system according to claim 18, wherein the metallic substrate comprises a metal selected from the group consisting of steel, an alloy, copper, aluminum, and combinations thereof.

20. A hybrid roofing system according to claim 18, wherein the substrate is completely covered by at least one layer of metallic substrate.

21. A hybrid roofing system according to claim 16, wherein the first layer completely covers the second layer except at the inter-tab openings.

22. A hybrid roofing system according to claim 16, wherein the first layer comprises a metallic substrate.

23. A hybrid roofing system according to claim 22, wherein the metallic substrate comprises a metal selected from the group consisting of steel, an alloy, copper, aluminum, and combinations thereof.

24. A hybrid roofing system according to claim 16, wherein the first layer comprises a polymeric substrate.

* * * * *